US005093935A

United States Patent [19]

Countee, Jr.

[11] Patent Number: 5,093,935

[45] Date of Patent: Mar. 10, 1992

[54] UNDERGARMENT WITH STORAGE POCKET

[76] Inventor: Jerome T. Countee, Jr., 706 60th Pl., Fairmount Heights, Md. 20743

[21] Appl. No.: 595,332

[22] Filed: Oct. 10, 1990

[51] Int. Cl.[5] ..... A41B 9/02

[52] U.S. Cl. ..... 2/400; 2/402; 2/403; 2/247; 450/89

[58] Field of Search ..... 2/400, 402, 403, 405, 2/406, 67, 73, 78 A, 78 B, 247, 248, 250; 450/89, 133, 150, 122, 123; 128/159

[56] References Cited

U.S. PATENT DOCUMENTS

| | | | |
|---|---|---|---|
| Re. 20,567 | 12/1937 | Bachelis | 2/403 X |
| 1,599,687 | 9/1926 | Sullivan . | |
| 2,235,848 | 3/1941 | Reis | 128/159 |
| 2,336,248 | 12/1943 | Harwood | 2/405 X |
| 2,492,862 | 12/1949 | Harvey . | |
| 2,498,048 | 2/1950 | Neinken | 2/247 |
| 2,544,840 | 3/1951 | Kowatschi | 2/67 |
| 2,593,711 | 4/1952 | Weatherly | 450/89 |
| 2,601,602 | 6/1952 | Firschung, Sr. | 2/403 X |
| 2,610,325 | 9/1952 | Schlussel | 450/89 |
| 2,624,881 | 1/1953 | Lee | 450/89 |
| 2,725,573 | 12/1955 | Kornhauser | 2/247 |
| 2,822,807 | 2/1958 | Heyman | 128/159 |
| 3,137,862 | 6/1964 | Mizerak | 2/224 |
| 3,459,181 | 8/1969 | Mann | 2/403 X |
| 3,871,030 | 3/1975 | Green | 2/238 |
| 4,145,762 | 3/1979 | Wallach | 2/67 |
| 4,156,294 | 5/1979 | Horn | 2/400 |
| 4,498,200 | 2/1985 | Livingstone | 2/247 |
| 4,533,355 | 8/1985 | Fair | 2/403 X |
| 4,602,390 | 7/1986 | Morera et al. | 2/251 |
| 4,638,579 | 1/1987 | Gamm | 2/247 X |
| 4,961,235 | 10/1990 | Williger | 2/247 X |

FOREIGN PATENT DOCUMENTS

| | | | |
|---|---|---|---|
| 1537902 | 7/1968 | France | 128/159 |
| 2143422 | 2/1985 | United Kingdom | 2/400 |

*Primary Examiner*—Werner H. Schroeder
*Assistant Examiner*—Jeanette E. Chapman
*Attorney, Agent, or Firm*—Seidel, Gonda, Lavorgna & Monaco

[57] ABSTRACT

An undergarment which include a centrally-located pocket for the storage of small items, such as prophylactics. A crotch panel is generally attached by its edges to the front of the garment, the crotch panel extending from the waist opening to an area between the leg openings, forming a closed space between the garment and the crotch panel. An opening is defined to provide access to the enclosed space.

16 Claims, 2 Drawing Sheets

FIG. 4
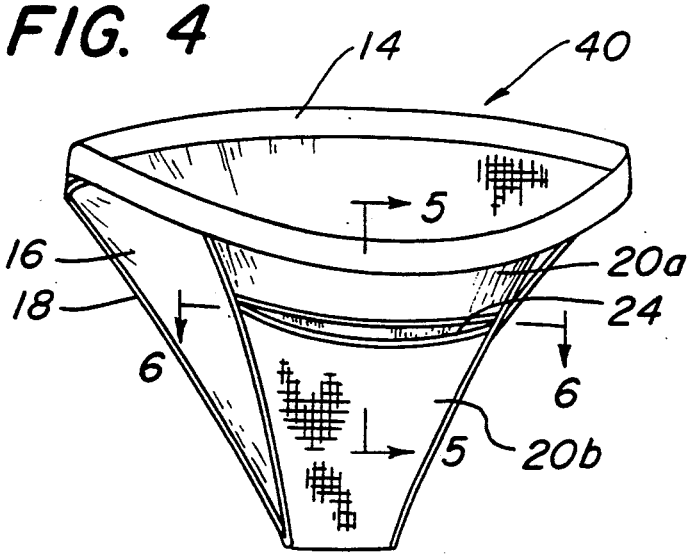
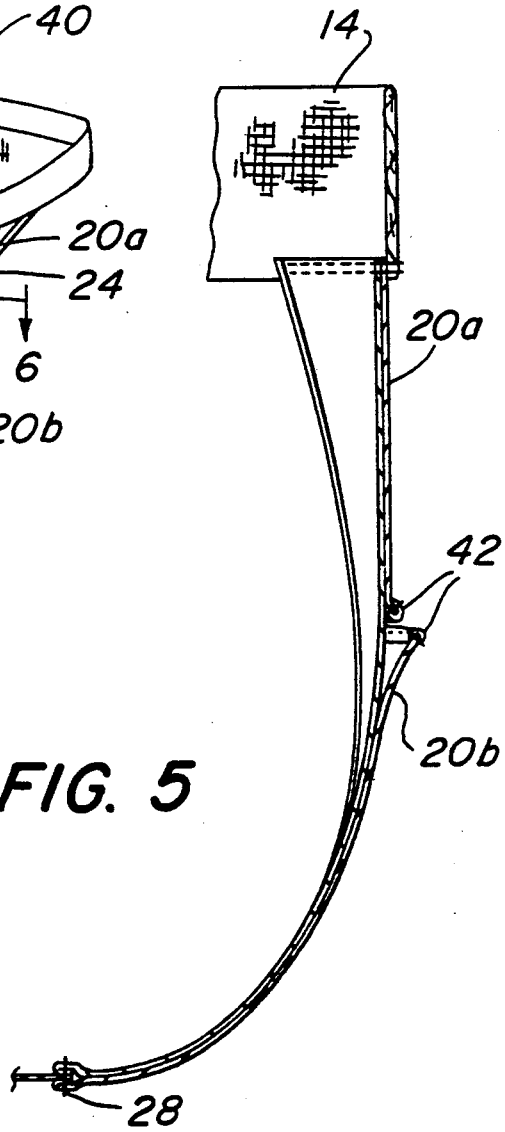
FIG. 5
FIG. 6
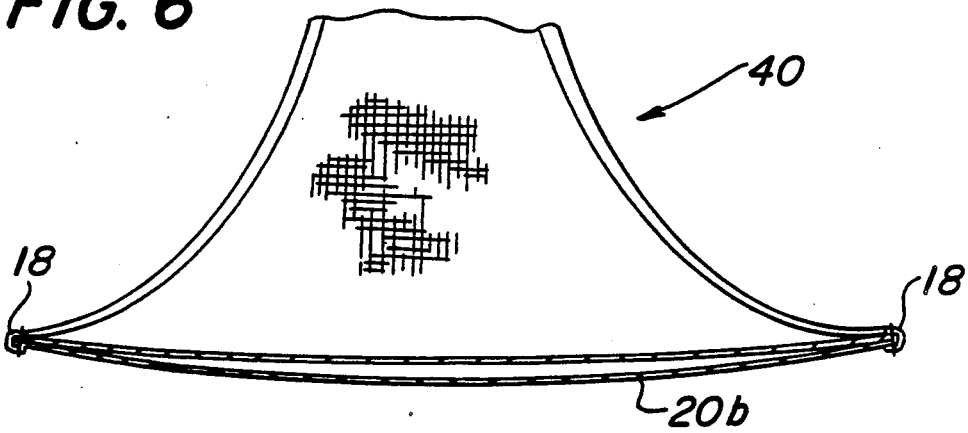

UNDERGARMENT WITH STORAGE POCKET

FIELD OF THE INVENTION

The present invention relates to an undergarment having a storage pocket.

SUMMARY OF THE INVENTION

With the current prevalence of sexually-transmitted diseases, the use of prophylactic devices has been encouraged by health authorities. In order to encourage the use of such devices, it is helpful to maximize the convenience of them by allowing a potential user to have handy access to such a device when needed.

The present invention is a garment having a wearable main portion defining a waist opening and two leg openings. A crotch panel is generally attached by its edges to the main portion extending from the edge of the waist opening to an area between the leg openings, to form an enclosed space between the main portion and the crotch panel. A seam generally perpendicular to the edge defining the waist opening forms a pocket between the seam and the edge of the waist opening and between the crotch panel and the main portion. A pocket opening is defined in the garment to provide access to the interior of the pocket.

The pocket of the present invention within the undergarment is suitable for holding a prophylactic within its protective wrapper to provide convenient access to the prophylactic and to remind the undergarment wearer to use it. Of course, the pocket can be used to store other items as well, such as money, keys, credit cards, hygiene devices, and the like. The present invention has the further advantage of being easily manufactured.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 4 is a perspective view of a second embodiment of the present invention.

FIG. 5 is a cross-sectional view thereof through line 5—5 of FIG. 4.

FIG. 6 is a cross-sectional view thereof through line 6—6 of FIG. 4.

DETAILED DESCRIPTION OF THE INVENTION

Figure 1:
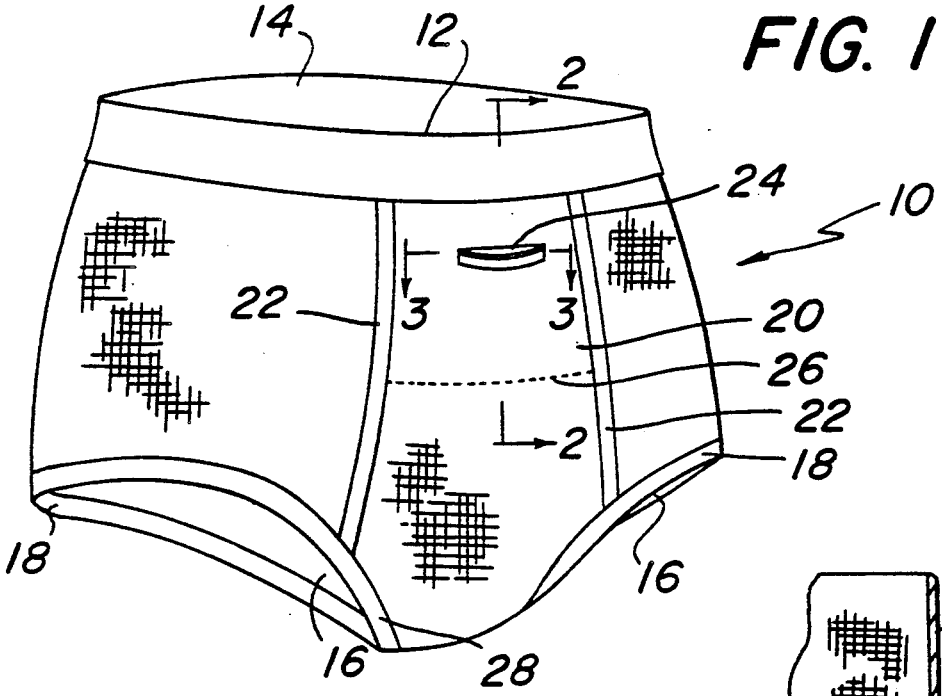
FIG. 1 is a perspective view of one embodiment of the present invention.

FIG. 1 is a perspective view of one preferred embodiment of the present invention, in the form of men's briefs. The briefs 10 are of customary design, including a waist band 14, which is preferably of an elastic material, and which defines a waist opening 12. The briefs 10 further include the leg openings 16, which may be defined by reinforced by fabric tapes 18 that may be of an elastic or inelastic material.

In the preferred embodiment of the invention, a crotch panel 20 is provided at the front of the garment. The crotch panel 20 is a piece of material which is generally attached by its edges to the front of the garment, and extends from the waist band 14 to an area between the leg openings 16. The crotch panel 20 may be attached by simple seams but is preferably attached by double-stitched taping seams 22, which are commonly used for men's briefs. The attachment points for the crotch panel 20 may be coextensive with the edges of the leg openings 16, and the taping seams 22 may be of the same type as the fabric strips 18.

As the crotch panel 20 is attached to the front of the garment by its edges, an enclosed space is formed between the main portion of garment 10 and the crotch panel. Defined in the crotch panel adjacent the waist band 14 is an opening 24. This opening 24 provides access to the space between the crotch panel 20 and the front of the garment 10, creating a storage pocket suitable for small miscellaneous items. Further, a horizontal seam 26 is disposed generally toward the middle of the crotch panel 20. As shown, seam 26 is generally parallel to the edge of the waist band 14. This seam 26 serves to close off the bottom of the pocket, so that items inserted through opening 24 do not fall too far down the pocket. Thus, the items deposited within the pocket remain easily accessible through the opening 24.

On the side of the seam 26 opposite that forming the storage pocket, conventional fly means 28 may be provided, as is common in men's underwear. The fly means 28 may be created by shaping of the crotch panel 20 in cooperation with an opening (not shown) in the main portion of the garment. Thus, the pocket means of the present invention may be provided by modifying well-known underwear designs, since men's briefs typically include a front crotch panel and fly means.

Figure 2:
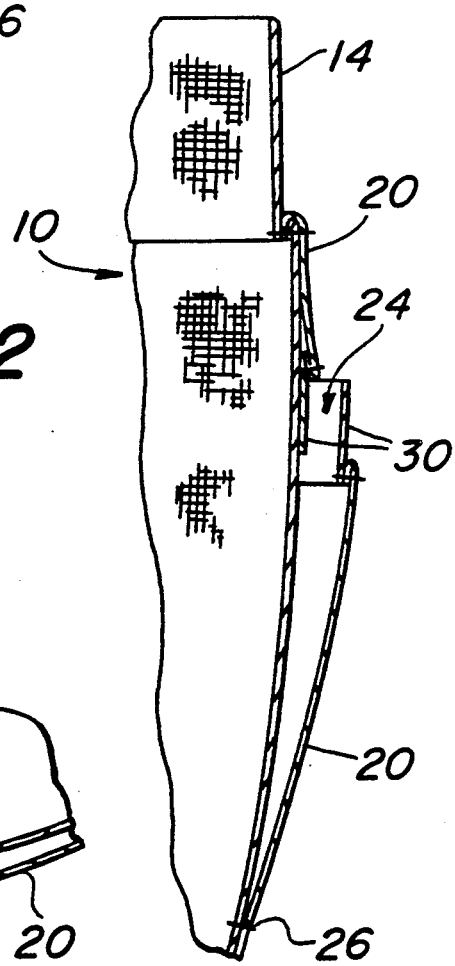
FIG. 2 is a cross-sectional view thereof through line 2—2 ,of FIG. 1.
Figure 3:
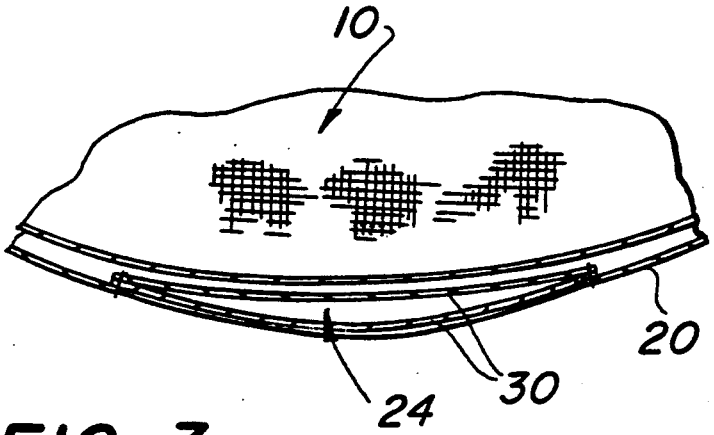
FIG. 3 is a cross-sectional view thereof through line 3—3 of FIG. 1.

FIGS. 2 and 3 are cross-sectional views through the briefs 10, showing the preferred structure of the storage pocket. The opening 24 is preferably reinforced by stitching in fabric tapes 30 on both sides of the opening, as shown. The fabric tapes 30 may be of an elastic material, if desired. The edges of the opening 24 may alternatively be reinforced through other means such as lapping or piping. The reinforcements increase the durability of the garment, and prevent ripping and sagging in the area around the opening 24.

FIGS. 4–6 show another preferred embodiment of the present invention, in the form of women's panties 40. In FIGS. 4–6, those parts of the garment 40 which are equivalent to those in briefs 10 of FIGS. 1–3 are numbered correspondingly. The primary structural difference between briefs 10 and panties 40 is that the edges of the crotch panel 20 are coextensive with the front portion of the edges of the leg openings 16, and therefore the side edges of the crotch panel 20 and any elastic or reinforcement fabric tapes 18 around the edges of the leg openings 16 may be attached by a single seam. Further, because there are no side seams 22 on crotch panel 20, the opening 24 may extend the entire length between the leg openings 16. Where the opening 24 extends this full length, it is necessary to divide the crotch panel into an upper portion **20*a* and lower portion 20*b*, the latter forming the storage area of the storage pocket with the main portion of the panties 40**.

FIGS. 5 and 6 are cross-sectional views of the panties 40, showing a piping 42 around the edges of the fabric of crotch panel **20*a* and 20*b*. In this embodiment of the invention, the seam 28 is used not only to form the bottom of the pocket, but also to attach the crotch panel to the rest of the garment. As shown in FIG. 5, seam 28** may also serve to attach the front and back panels forming the main portion of the garment.

The present invention may be embodied in other specific forms without departing from the spirit or essential attributes thereof and, accordingly, reference should be made to the appended claims, rather than to the foregoing specification, as indicating the scope of the invention.

I claim:

1. A garment, comprising:

a wearable main portion, having means defining a waist opening and two leg openings;

a crotch panel attached by its edges to the main portion and extending generally from the waist opening to an area adjacent the leg openings, thereby forming an enclosed space between the main portion and the crotch panel;

a seam through both the crotch panel and main portion extending across the crotch panel, the seam forming a pocket within the enclosed space between the main portion and the crotch panel, the pocket positioned between the seam and an edge of the waist opening; and means for providing access to the pocket.

2. A garment as in claim 1, wherein the access means is positioned on the crotch panel.

3. A garment as in claim 1, wherein the access means is positioned on the main portion opposite the crotch panel.

4. A garment as in claim 1, further including reinforcing means stitched around at least a portion of the access means.

5. A garment as in claim 4, wherein the reinforcing means includes fabric tape.

6. A garment as in claim 4, wherein the reinforcing means includes fabric piping.

7. A garment as in claim 1, wherein at least a portion of the edges of the crotch panel are attached coextensive with the edges of the leg openings.

8. A garment as in claim 1, wherein the seam extending across the crotch panel is generally parallel to the edge of the main portion defining the waist opening.

9. A garment as in claim 8, wherein the seam generally parallel to the edge of the main portion defining the waist opening is disposed generally toward the midpoint of the crotch panel.

10. A garment as in claim 8, further including fly means disposed in the crotch panel on the side of the seam opposite that of the access means.

11. An undergarment, comprising:

a wearable main portion, having means defining a waist opening and two leg openings;

a crotch panel, generally attached by its edges to the main portion, extending generally from an edge formed by the waist opening to an area between the leg openings, thereby forming an enclosed space between the main portion and the crotch panel;

a seam through both the crotch panel and main portion, disposed generally toward a midpoint of the crotch panel, extending across the crotch panel, the seam forming a pocket between the seam and the edge of the waist opening and between the crotch panel and the main portion;

means for providing access to the pocket; and fly means disposed in the crotch panel on a side of the seam opposite that of the access means.

12. An undergarment as in claim 11, wherein the seam extending across the crotch panel is generally parallel to the edge of the main portion defining the waist opening.

13. An improved undergarment having a wearable main portion defining a waist opening and two leg openings, a crotch panel extending from the waist opening to an area adjacent the leg opening, wherein the improvement comprises:

means for attaching the edges of the crotch panel to the main portion, thereby forming an enclosed space between the main portion and the crotch panel;

a seam through both the crotch panel and main portion, disposed generally toward a midpoint of the crotch panel extending across the crotch panel, the seam forming a pocket between the seam and an edge of the waist opening and between the crotch panel and the main portion; and means for providing access to the pocket.

14. An improved undergarment as in claim 13, wherein the seam extending across the crotch panel is generally parallel to the edge of the main portion defining the waist opening.

15. A garment, comprising:

a wearable main portion, having means defining a waist opening and two leg openings;

a crotch panel having a pocket opening, attached by its edges to the main portion and extending generally from the waist opening to an area adjacent the leg openings, thereby forming an enclosed space between the main portion and the crotch panel, and wherein the pocket opening provides access to the enclosed space; and a seam through both the crotch panel and main portion extending across the crotch panel, the seam forming a pocket within the enclosed space between the main portion and the crotch panel, the pocket and the pocket opening positioned between the seam and an edge of the waist opening.

16. A garment, comprising:

a wearable main portion having a pocket opening and means defining a waist opening and two leg openings;

a crotch panel attached by its edges to the main portion and extending generally from the waist opening to an area adjacent the leg openings, thereby forming an enclosed space between the main portion and the crotch panel; and a seam through both the crotch panel and main portion extending across the crotch panel, the seam forming a pocket within the enclosed space between the main portion and the crotch panel, the pocket and a pocket opening positioned between the seam and an edge of the waist opening, wherein the pocket opening provides access to the pocket.

* * * * *